US006428109B1

(12) United States Patent
Lerchbaum et al.

(10) Patent No.: US 6,428,109 B1
(45) Date of Patent: Aug. 6, 2002

(54) MINING MACHINE WITH SLIDING CUTTING TOOL ASSEMBLY

(75) Inventors: Karl Lerchbaum, Zeltweg; Peter Kogler, Knittelfeld, both of (AT)

(73) Assignee: Voest-Alpine Bergtechnik Gesellschaft m.b.H., Zeltweg (AU)

( * ) Notice: Subject to any disclaimer, the term of this patent is extended or adjusted under 35 U.S.C. 154(b) by 0 days.

(21) Appl. No.: 09/530,608

(22) PCT Filed: Nov. 3, 1998

(86) PCT No.: PCT/AT98/00269

§ 371 (c)(1),
(2), (4) Date: May 3, 2000

(87) PCT Pub. No.: WO99/23358

PCT Pub. Date: May 14, 1999

(30) Foreign Application Priority Data

Nov. 4, 1997 (AT) ..... 1866/97

(51) Int. Cl.[7] ..... E21C 27/24
(52) U.S. Cl. ..... 299/75
(58) Field of Search ..... 299/73, 74, 75, 299/76

(56) References Cited

U.S. PATENT DOCUMENTS

| | | | | |
|---|---|---|---|---|
| 4,297,057 A | * | 10/1981 | O'Neil | 175/219 |
| 4,445,663 A | * | 5/1984 | Goyarts | 248/371 |
| 4,740,037 A | | 4/1988 | Eager et al. | 299/45 |
| 4,753,486 A | | 6/1988 | Le Begue | 299/11 |
| 4,770,469 A | * | 9/1988 | Schnellenberg et al. | 299/75 |
| 4,865,390 A | * | 9/1989 | Shrader et al. | 198/522 |
| 5,050,934 A | | 9/1991 | Brandl et al. | 299/33 |
| 5,072,994 A | * | 12/1991 | Brandl et al. | 299/67 |
| 5,333,936 A | * | 8/1994 | Zitz | 299/75 |
| 5,795,032 A | * | 8/1998 | Zimmerman | 299/33 |

FOREIGN PATENT DOCUMENTS

| | | |
|---|---|---|
| DE | 196 23 653 A1 | 12/1996 |
| GB | 2 228 755 A | 9/1990 |
| GB | 2 196 666 A | 5/1998 |
| WO | 92/05339 | 4/1992 |

* cited by examiner

*Primary Examiner*—David Bagnell
*Assistant Examiner*—John Kreck
(74) *Attorney, Agent, or Firm*—Kevin E. Joyce

(57) ABSTRACT

In a cutting machine (2), including rotatably mounted cutting or shearing tools (19), a loading ramp and a hauling means (4) extend in a direction towards a mine face for receiving and hauling cut or sheared material. The cutting or shearing tools (19) are mounted on a slide which is displaceable on guides extending in the longitudinal direction of the machine. The guides are comprised of tubes or rods connected with a machine flame in the region of the track-laying gears (1), preferably within the track-laying gear frame. The slide is comprised of longitudinal spars (10) and a crossbeam (9) for mounting the cutting or shearing tools (19). The machine frame, at least in its front region adjacent the crossbeam (9), is designed as a box section (3), within the clear width of which the hauling means (4) is guided in a manner so as to be displaceable in the longitudinal direction of the machine.

9 Claims, 3 Drawing Sheets

MINING MACHINE WITH SLIDING CUTTING TOOL ASSEMBLY

This application is the national phase of international application PCT/AT98/00269 filed Nov. 3, 1988 which designated the U.S.

BACKGROUND OF THE INVENTION

1. Field of the Invention

The invention relates to a cutting machine including rotatably mounted cutting of shearing tools, a loading ramp and a hauling means extending in the direction towards the mine face for receiving and hauling the cut of sheared material, in which the cutting or shearing tools are mounted on a slide which is displaceable on guides extending in the longitudinal direction of the machine.

2. The Prior Art

DE-A1 40 18 154 describes a cutting machine in which the entire machine frame of an advance working machine is designed to be displaceable relative to the track-laying gear. The guiding means are arranged to extend in the longitudinal direction of the machine on both sides of the track-laying gear, with the guiding elements that are connected with the track-laying gear being encompassed. The entire machine frame is displaced in the longitudinal direction of the machine relative to the idle track-laying gear.

U.S. Pat. No. 5,333,936 describes a configuration in which the slide is designed as a self-supporting box section in whose clear opening a haulage means is slidably mounted. The slide or box section in that case is displaced in the longitudinal direction of the machine along a slideway arranged above the track-laying gear. Moreover, a stationary machine frame is additionally provided, which is designed as a frame of low rigidity and connects the two track-laying gears. Yet, in the main, it is again the entire machine frame which is displaced relative to the track-laying gear, whereby all the other devices of a cutting machine are being displaced along with the machine frame.

While it has already been possible to substantially reduce the structural height in the known configurations, the free space required for a safe anchorage near the mine face still has remained relatively restricted. The invention now aims to further develop an advance working machine of the initially defined kind to the extent that, in addition to providing a particularly low structure for use in low seams, it will also be feasible to employ anchor boring and setting devices immediately behind a cutting tool, such anchor boring and setting devices allowing the whole anchor section required to be introduced in a simple manner. During the anchoring and setting of the anchors, parallel cutting operations are not to be affected in any manner whatsoever and the cutting forces are to be supported to a sufficient extent even during anchoring.

SUMMARY OF THE INVENTION

To solve this object, the cutting machine according to the invention of the initially defined kind essentially consists in that the guides are comprised of tubes or rods connected with a machine frame in the region of the track-laying gears, preferably within the track-laying gear frame, that the slide is comprised of longitudinal spars and a crossbeam for mounting the cutting or shearing tools and that the machine frame, at least in its front region adjacent the crossbeam, is designed as a box section in whose clear width the hauling means is guided in a manner displaceable in the longitudinal direction of the machine. By providing a machine frame that is designed as a box section and comprises guides in the region of the track-laying gears, a particularly stable machine frame is provided, said frame being able to receive the hauling means for hauling the sheared or extracted material at an extremely low structural height of the overall device. By the slide being slidably guided on the tubes or rods, it is feasible to arrange also the slide relatively low, enabling the cutting tools to be appropriately fixed on the slide without enlarging the structural height of the overall machine due to the slide being formed by longitudinal spars and an end-side crossbeam. Hence remains a sufficiently large free space on the machine frame behind the crossbeam which is displaceable in the longitudinal direction of the machine along with the slide, in which anchor boring and setting devices may be employed for a flexible use aimed at an anchorage over the total anchor section required.

The machine frame, which carries the guides for the slide in the plane of the crawlers of the track-laying gear, in an advantageous manner may comprise suitable upwardly directed mounting means, such as a mounting plate or mounting spars for arranging anchor boring and setting devices, merely on its front end facing the crossbeam, so that those anchor boring and setting devices likewise may be hinged to, or supported on, the machine frame in a low-structured manner so as to provide for a large pivoting range and hence a large working range for the anchor boring and setting devices. This is of particular importance not least because of the fact that anchors having lengths of several meters may be employed for a reliable anchorage, which anchors at an accordingly low articulation of the anchor boring and setting devices to the machine frame, can be safely introduced into the anchor boring and setting devices, and hence set, without cumbersome manipulations.

Advantageously, the configuration according to the invention is devised such that the slide and, in particular, the longitudinal spars connected with the crossbeam comprise (s) lugs at least partially encompassing the guides and is displaceable in the longitudinal direction of the machine by means of at least one hydraulic cylinder piston unit that is supported on the machine frame. The displaceable slide and, in particular, the longitudinal spars connected with the crossbeam, thus, may likewise be arranged substantially in the plane of the track-laying gear, thereby further reducing the structrual height.

On account of its structure comprised of longitudinal spars and crossbeams, the slide is displaceable substantially in the plane of the track-laying gear, the appropriate free space for hauling the cut material having to be provided merely in the region near the mine face. This is feasible in a particularly simple manner by a suitable configuration of the front-side crossbeam, wherein the configuration advantageously is devised such that the crossbeam of the displaceable slide encompasses the box section of the machine frame in a portal-like manner. The lower region of the crossbeam is not necessary for the articulate connection of cutting tools such that a portal-like structure of this type provides an additional free space at a low structural height, enabling the cut material to be safely removed. Such a portal-like configuration of the crossbeam or a portal connected with the crossbeam stretches a plane which results in an L-shaped configuration of the slide in side view, an appropriate free space for actuator and control units as well as energy supply means of the cutting machine, thus, remaining in the region above the machine frame at an overall extremely low structural height.

In a particularly simple manner, the configuration according to the invention is devised such that the mounting plate or the mounting spars extend(s) substantially parallel with the portal-like crossbeam of the slide and, in the side view, enclose(s) an angle with the longitudinal axis of the machine in the direction towards the mine face of less than, or equal to, 90°. Such an inclination of the mounting plate or mounting spars enables anchors to be set as far as to near the mine face without impeding the cutting or shearing operation.

A particularly stable support of the machine during the cutting operation and hence a further enhancement of the anchor boring and setting operation may be obtained in that the machine frame comprises supporting consoles for supporting props outside the track-laying gear. The support is, thus, ensured over a large width such that a particularly stable structure having but a low structural height is achieved.

In order to further enhance the operating range of the anchor boring and setting devices, the configuration advantageously is devised such that the anchor boring and setting devices are connected with the mounting plate or mounting spars in a manner so as to be pivotable about a pivot axis substantially extending in the longitudinal direction of the machine. The advantages of the low mode of construction of the overall machine are thereby optimally utilized, since the pivot axis for the anchor boring and setting device may be arranged near the floor, thus enabling even long anchors to be safely inserted into the anchor boring and setting devices and manipulated.

A particularly efficient anchor boring and setting operation may be safeguarded if at least two anchor boring and setting devices arranged in a V-shaped manner on a common carrier are pivotably connected with the mounting plate or mounting spars of the machine frame, the common pivot axis being located on the level of a lower pivot axis of a multipart cantilever arm for cutting tools on the portal-like crossbeam of the slide, or below said pivot axis. Such an arrangement of the anchor boring and setting device and a pivot axis that is located on an accordingly low level enable the economic introduction of the total anchor section required while additionally enhancing the support of the machine frame by means of the supporting props arranged on the supporting consoles.

In order to be able to appropriately set anchors also near the mine face, the configuration advantageously is devised such that the pivot axes of the cantilever arms are arranged substantially parallel with the longitudinal axis of the machine and the pivot axis of the anchor boring and setting device is arranged to be downwardly inclined towards the mine face.

Haulage may be adapted to the respective requirements to the optimum degree in that the loading ramp in a manner so as to be pivotable in the height direction is connected with the hauling means which is displaceable in the longitudinal direction of the machine, wherein the hauling means may be accommodated in the box section of the machine frame rigidly connected with the track-laying gear at a very low overall structural height.

BRIEF DESCRIPTION OF THE DRAWINGS

In the following, the invention will be explained in more detail by way of the exemplary embodiments schematically illustrated in the drawing.

Therein.

DETAILED DESCRIPTION OF PREFERRED EMBODIMENTS OF THE INVENTION

Figure 1:
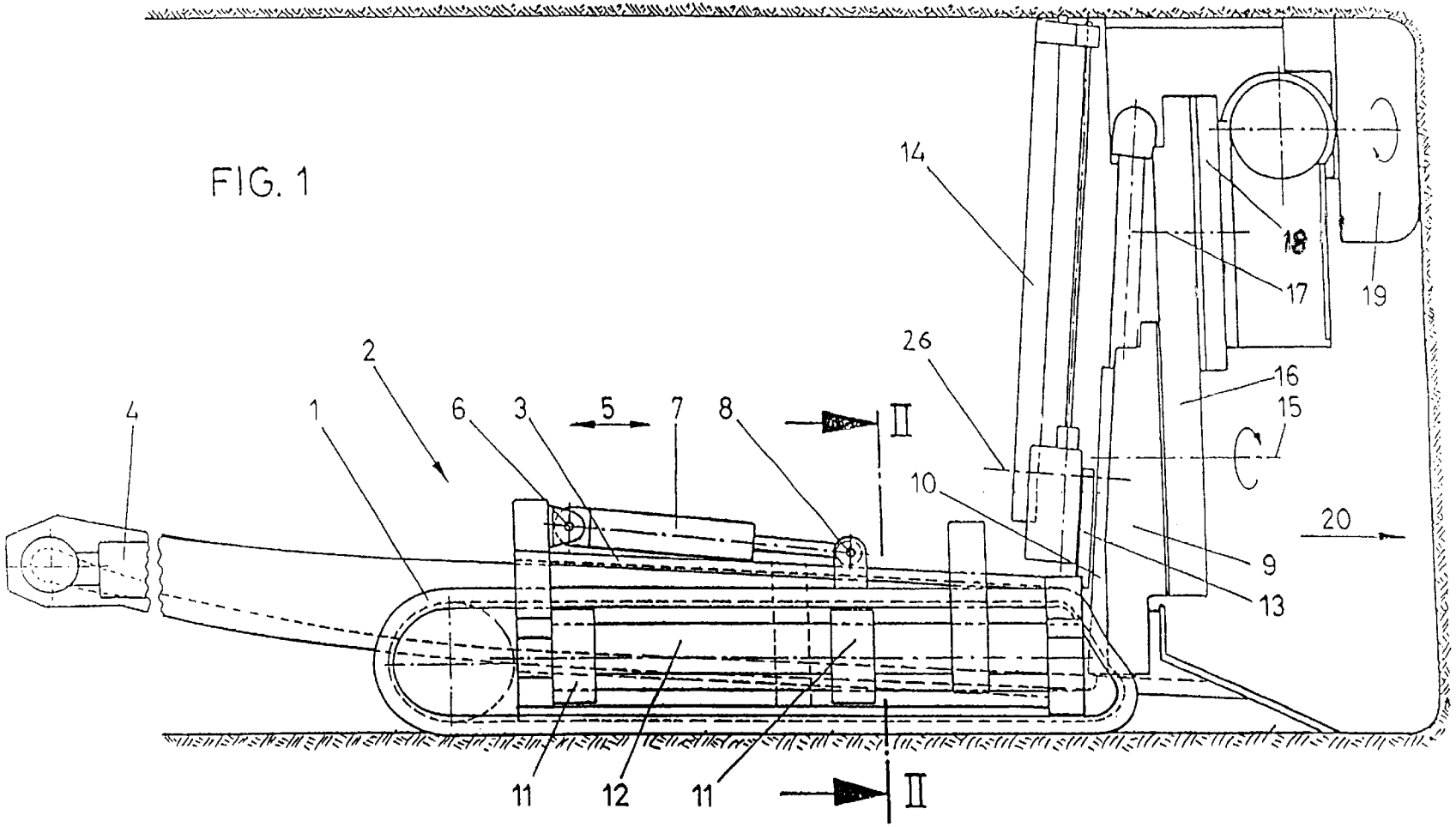
FIG. 1 is a schematic side view of the machine according to the invention.

In FIG. 1, a track-laying gear of a cutting machine 2 is denoted by 1. The machine frame is designed as a box section 3, in which a hauling means, whose rear end is schematically indicated by 4, is displaceably mounted in the direction of the double arrow 5. This box section 3, which is stationary relative to the track-laying gear, constitutes a torsionally firm machine frame to whose rear end a hydraulic cylinder piston unit 7 is hinged via a lug 6, contacting the displaceable slide at 8. The displaceable slide comprises a portal-likely designed crossbeam 9 which is connected with longitudinaly carriers or longitudinal spars 10 extending in the longitudinal direction of the machine. These longitudinal spars 10 again are connected with lugs 11 encompassing guide tubes or rods 12. These guide tubes or rods 12 in the plane of the track-laying gear 1 are each rigidly connected with the machine frame comprising said box section 3. Upon actuation of the hydraulic cylinder piston unit 7, the crossbeam 9 is, thus, displaced through the lugs 11 along the tubes or rods 12 in the direction of the double arrow 5 together with the longitudinal spars 10 extending in the longitudinal direction of the machine, the machine frame itself being immovably connected with the track-laying gear 1. On the front end of the machine frame or box section 3 is arranged a mounting plate or mounting spars 13, on which anchor boring and setting mean s 14 are fixed so as to be pivotable about an axis 26.

To the port al-likely designed crossbeam 9 is hinged, in a manner pivotable about a first pivot axis 15, a cantilever arm 16 to which a further cantilever arm 18 is pivotably hinged so as to be pivotable about a second pivot axis 17. The cutting tool is schematically in dicated by 19 and comprises of a cut ting head. In principle, any desired short-structured extraction tools may be fixed to the crossbeam.

The mounting plate 13 is forwardly inclined relative to the mine face such that the pivot axis 26 of the anchor boring and setting devices 14 likewise extends in a manner downwardly inclined relative to the mine face 20, thus enabling anchors to be in troduced closer to the mine face.

Figure 2:
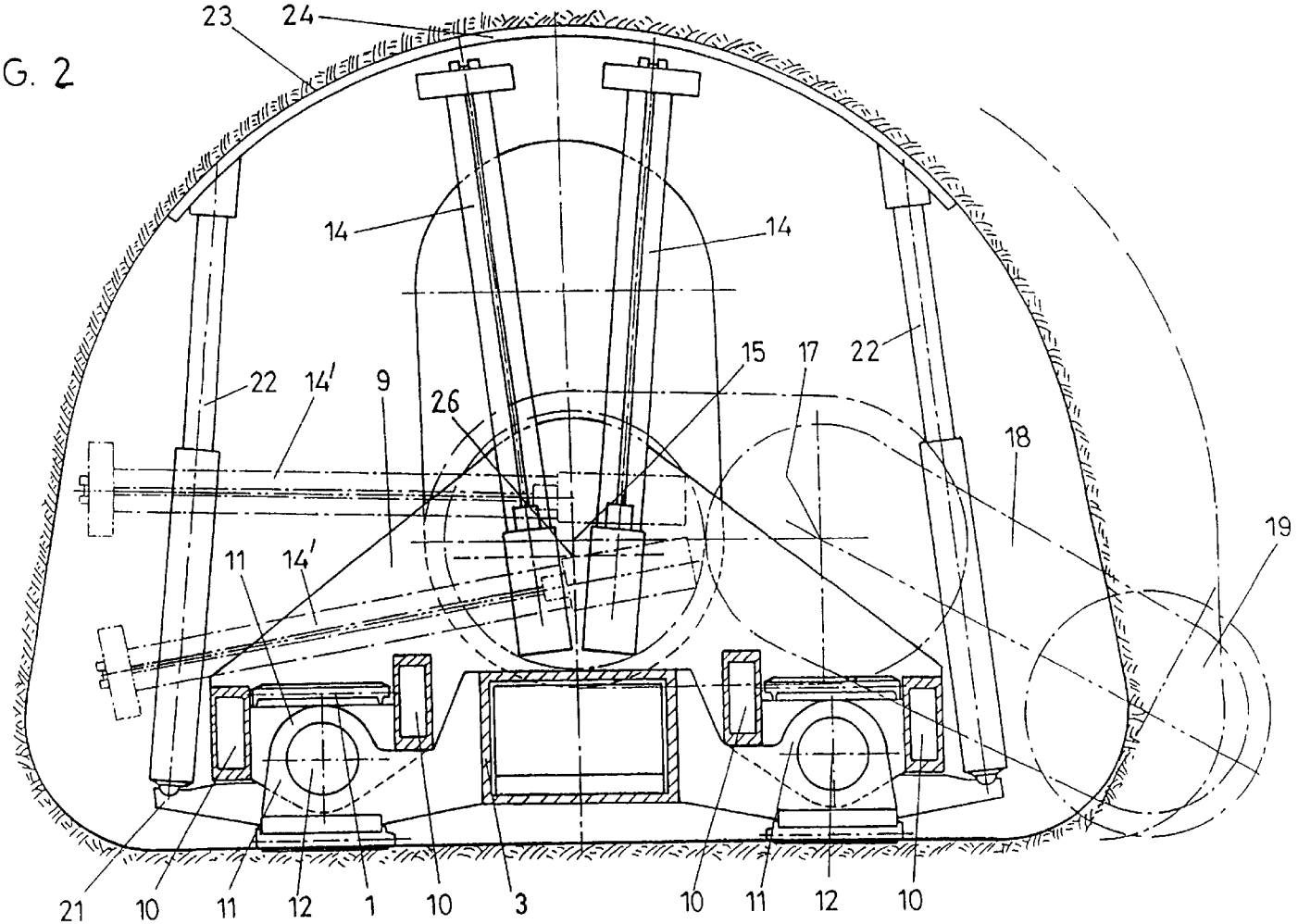
FIG. 2 is a partially sectioned view in the direction of the arrow II—II.
Figure 3:
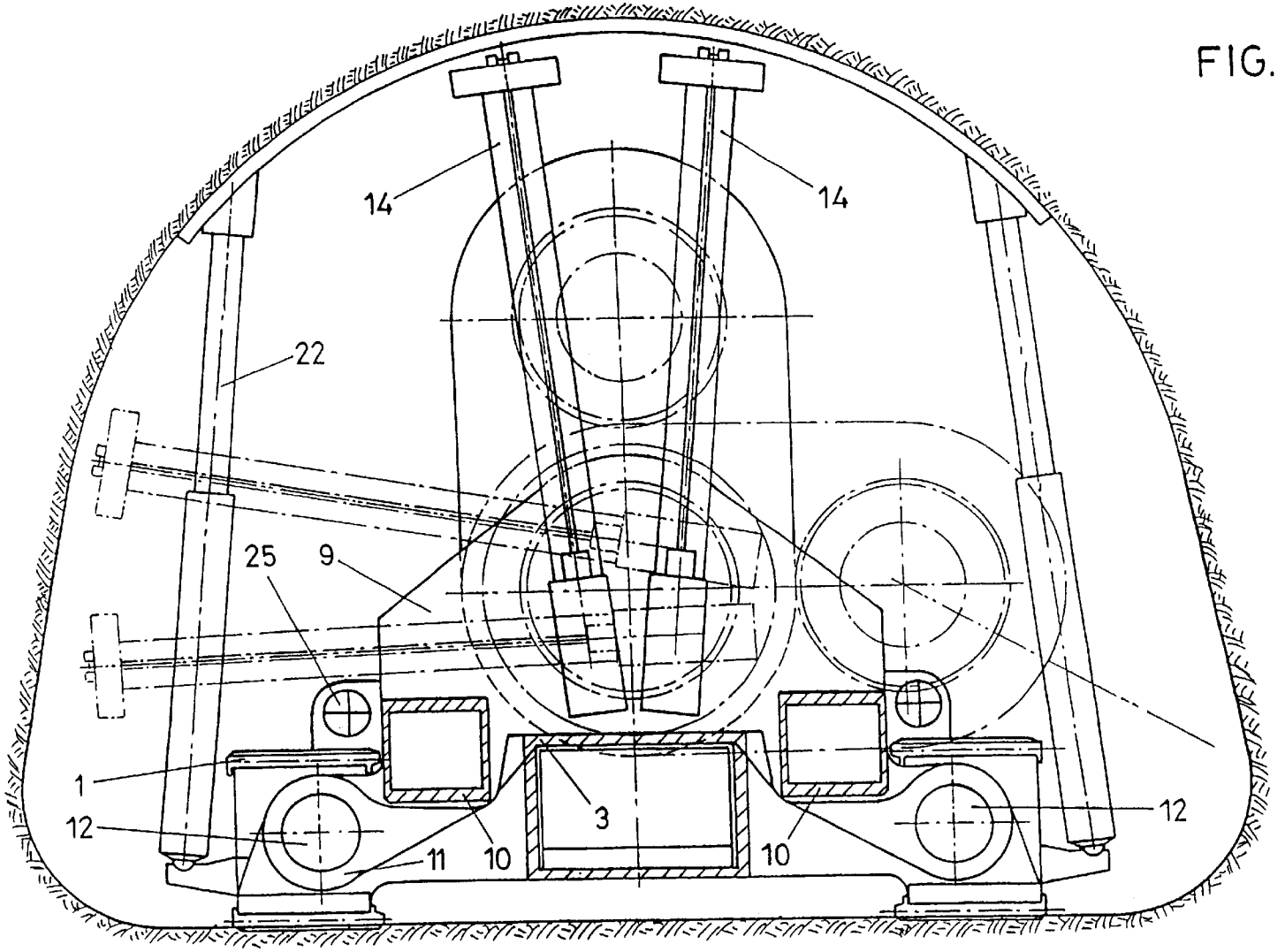
FIG. 3 is a view analogous to FIG. 2, through a modified configuration of the displaceable slide.

The structure is explained in more detail by way of different slide constructions depicted in FIGS. 2 and 3. In FIG. 2, the portal-likely designed crossbeam 9 is connected with four Spars 10 extending in the longitudinal direction of the machine. The machine frame, which is designed as a b ox section 3, carries the tubes or rods 12 encompassed by the lugs 11 of the slide. Lateral of the track-laying gear 1 are arranged supporting consoles 21 for supporting prop s 22, via which the roof 23 is supported using appropriate roof members 24. From the illustration according to FIGS. 2 and 3, it is apparent that two anchor boring and setting devices 14 are each mounted on a common carrier in a V-shaped manner, the common pivot axis again being denoted by 26. By pivoting the anchor boring and setting devices 14 into positions 14' it is elucidated that the whole clear cross section of the roadway can be drilled in a reliable manner by means of such anchor boring and setting devices. The working range of the cutting tool 19 is schematically indicated by the dot-and-dash contour of the cutting head 19, the second articulation axis of the second cantilever arm 18 again being denoted by 17.

In the configuration according to FIG. 3, the slide, besides the crossbeam 9 encompassing the box section 3 in a portal-like manner, merely comprises two frame spars 10, the displacement actuator being schematically indicated by 25. That displacement actuator 25 corresponds to the hydraulic cylinder piston unit 7 in FIG. 1. The remaining reference numerals have been retained unchanged relative to FIGS. 1 and 2.

What is claimed is:

1. A cutting machine for a mine, said machine being of the type which includes a rotatably mounted cutting tool, a loading ramp and a hauling arrangement extending in a direction towards a face of the mine for receiving and hauling material cut by the tool, said tool being mounted on a slide which is displaceable on guides extending in a longitudinal direction of the machine, wherein the guides comprise tubes or rods which are connected with a machine flame and which are located substantially within a plane of a track-laying gear frame, the slide including longitudinal spars and a crossbeam for mounting said tool, wherein the machine frame, at least in a front region adjacent the crossbeam, is formed as a box section having a width within which the hauling arrangement is guided so as to be displaceable in the longitudinal direction of the machine and wherein said crossbeam of the displaceable slide emcompasses the box section of the machine frame in a portal-like manner.

2. A cutting machine according to claim 1, wherein one of the machine frame on a side thereof facing away from the mine face, or the crossbeam of the slide, comprises a mounting for supporting anchor boring and setting devices.

3. A cutting machine according to claim 1 or 2, wherein the slide comprises lugs at least partially encompassing the guides and being displaceable in the longitudinal direction of the machine by means of at least one hydraulic cylinder piston unit that is supported on the machine frame.

4. A cutting machine according to claim 2, wherein the mounting extends upwardly substantially parallel with the crossbeam of the slide and is disposed at an angle with respect to the longitudinal axis of the machine, and extending towards the mine face, of up to 90°.

5. A cutting machine according to claim 1 or 2, wherein the machine frame comprises consoles for supporting props outside the track-laying gear frame.

6. A cutting machine according to claim 2, wherein the anchor boring and setting devices are connected with the mounting in a manner so as to be pivotable about a pivot axis extending substantially in the longitudinal direction of the machine.

7. A cutting machine according to claim 6, wherein at least two anchor boring and setting devices arranged in a V-shaped manner on a common carrier are pivotally connected with the mounting of the machine frame about a pivot axis located on or below the level of a pivot axis of a multipart cantilever arm for the tool on the crossbeam of the slide.

8. A cutting machine according to claim 7, wherein the pivot axis of the cantilever arm is arranged substantially parallel with the longitudinal axis of the machine and wherein the pivot axis of the anchor boring and setting devices is arranged to be downwardly inclined towards the mine face.

9. A cutting machine according to claim 1 or 2, wherein the loading ramp is vertically pivotable and is connected with the hauling arrangement which is displaceable in the longitudinal direction of the machine.

* * * * *